US006993797B1

(12) United States Patent
Yang

(10) Patent No.: US 6,993,797 B1
(45) Date of Patent: Feb. 7, 2006

(54) BATHTUB PILLOW

(75) Inventor: Tsan-Shin Yang, Dali (TW)

(73) Assignee: Golden Pond Plastic Manufacturing Company Ltd., (TW)

( * ) Notice: Subject to any disclaimer, the term of this patent is extended or adjusted under 35 U.S.C. 154(b) by 0 days.

(21) Appl. No.: 10/984,089

(22) Filed: Nov. 9, 2004

(51) Int. Cl.
*A47K 3/024* (2006.01)

(52) U.S. Cl. ..... 4/575.1; D6/601

(58) Field of Classification Search ..... 4/523, 4/559, 571.1, 575.1; D6/601
See application file for complete search history.

(56) References Cited

U.S. PATENT DOCUMENTS 1,953,798 A * 4/1934 De Grandcourt ..... 4/575.1
2,161,590 A * 6/1939 Rickard ..... 4/575.1
2,461,880 A * 2/1949 Curran ..... 4/575.1
5,140,713 A * 8/1992 Pesterfield ..... 4/575.1

* cited by examiner

*Primary Examiner*—Tuan Nguyen
(74) *Attorney, Agent, or Firm*—Jackson Walker, LLP

(57) ABSTRACT

A bathtub pillow has a resilient cover with a bulged portion having a cavity and a flat area formed around the bulged portion; a resilient spacer received inside the cavity of the resilient cover; multiple sucking disks formed under the flat area of the resilient cover; and a bottom grating detachably attached to the resilient cover to enclose the resilient spacer inside the bulged portion. Thereby, the bathtub pillow is detachable and has no seams formed on the bathtub pillow, whereby the bathtub pillow can be kept clean. The resilient spacer props the bulged portion to make the bathtub pillow have a certain flexible rigidity to support a user's head. The bottom grating allows water inside the bathtub pillow to drain out to enable the bathtub pillow dry out after use.

7 Claims, 6 Drawing Sheets

BATHTUB PILLOW

BACKGROUND OF THE INVENTION

1. Field of the Invention

The present invention relates to a bathtub pillow, and more particularly to a bathtub pillow that is easily combined and comfortable in use.

2. Description of Related Art

When people take a jacuzzi™ or spa bath, they are used to relaxing in the bathtub with their heads abutting edges of the bathtub. However, the edge of the bathtub is quite hard so those users feel discomfort after resting their heads on the edge of the bathtub for a long period of time. Therefore, a bathtub pillow is developed for people that particularly enjoy bubble bathing or spa bath.

With reference to FIGS. 5 and 6, a conventional bathtub pillow substantially comprises a sack (50), foam rubber (51) stuffing inside the sack (50), a netted pillowcase (52), two wings (521), and multiple sucking disks (522).

The sack (50) is made of plastic material in rectangular shape and hermetically contains the foam rubber (51) inside to make the sack (50) soft and resilient. The sack (50) further has two sides and two sheets (521) respectively extending from the two sides. The netted pillowcase (52) is made of foam material and attached around the sack (50) and is composed of two pieces respectively cover below and above the sack (50), including the two sheets to achieve the wings (521). Distal edges of the bathtub pillow and joints between the wings (521) and sack (50) are thermally compressed to combine the netted pillowcase (52) with the sheets of the sack (50). The multiple sucking disks (522) are attached under the wings (521) respectively by means of thermal compression. Therefore, the bathtub pillow is enabled to attach to the edge of the bathtub by suction force of the multiple sucking disks (522) to allow users to rest their heads on the soft bathtub pillow instead of the hard edge of the bathtub.

However, the conventional bathtub pillow still has some drawbacks:

1. The bathtub pillow easily becomes dirty because seams between transversal and longitudinal textures of the netted pillowcase (52) retain dirt that can not be easily removed.
2. The sack (50) made of plastic material deteriorates quickly and breaks. Then, water enters the sack (50) and is absorbed by the foam material so that the bathtub pillow becomes stinky and useless.
3. Manufacturing the conventional bathtub pillow is troublesome because the manufacturing processes include: putting the foam rubber (51) into the sack (50); sealing the sack (50); mounting the netted pillowcase (52) on the sack (50); and thermally compressing the pillowcase (52) to attach to the sheets on the sack (50) and the sucking disks (522). These manufacturing processes are complex and cause high manufacturing cost of the conventional bathtub pillow.
4. Moreover, the sack (50) and the netted pillowcase (52) can not be separated to clean the bathtub pillow because the netted pillowcase (52) is thermal compressed and fused with the sack (50) together.

The present invention has arisen to mitigate or obviate the disadvantages of the conventional bathtub pillow.

SUMMARY OF THE INVENTION

The main objective of the present invention is to provide an improved bathtub pillow that is easily detachable, comfortable and durable in use.

To achieve the foregoing objective, the bathtub pillow of the present invention comprises:

- a resilient cover with a bulged portion having a cavity and a flat area formed around the bulged portion;
- a resilient spacer received inside the cavity of the resilient cover;
- multiple sucking disks formed under the flat area of the resilient cover; and
- a bottom grating detachably attached to the resilient cover to enclose the resilient spacer inside the bulged portion.

Thus, there are no seams formed on the bathtub pillow and the bathtub pillow can easily be kept clean. The resilient spacer props the bulged portion to make the bathtub pillow have a certain flexible rigidity to support a user's head. The bottom grating allows water inside the bathtub pillow to drain out to allow the 3 bathtub pillow to dry out after use. Therefore, the bathtub pillow is comfortable in use.

Further benefits and advantages of the present invention will become apparent after a careful reading of the detailed description with appropriate reference to the accompanying drawings.

DETAILED DESCRIPTION OF THE INVENTION

A bathtub pillow in accordance with the present invention comprises: a resilient cover with a bulged portion having a cavity and a flat area formed around the bulged portion; a resilient spacer received inside the cavity of the resilient cover; multiple sucking disks formed under the flat area of the resilient cover; a bottom grating detachably attached to the resilient cover to enclose the resilient spacer inside the bulged portion; and an optional patterned cloth attached on the resilient cover.

Thereby, the bathtub pillow can be detached for cleaning easily and has no seams such that the bathtub pillow can be kept clean. The resilient spacer props the bulged portion to make the bathtub pillow have certain flexible rigidity to support a user's head. The bottom grating allows water inside the bathtub pillow to drain out to allow the bathtub pillow to dry out after use. Therefore, the bathtub pillow is detachable and comfortable in use.

Figure 1:
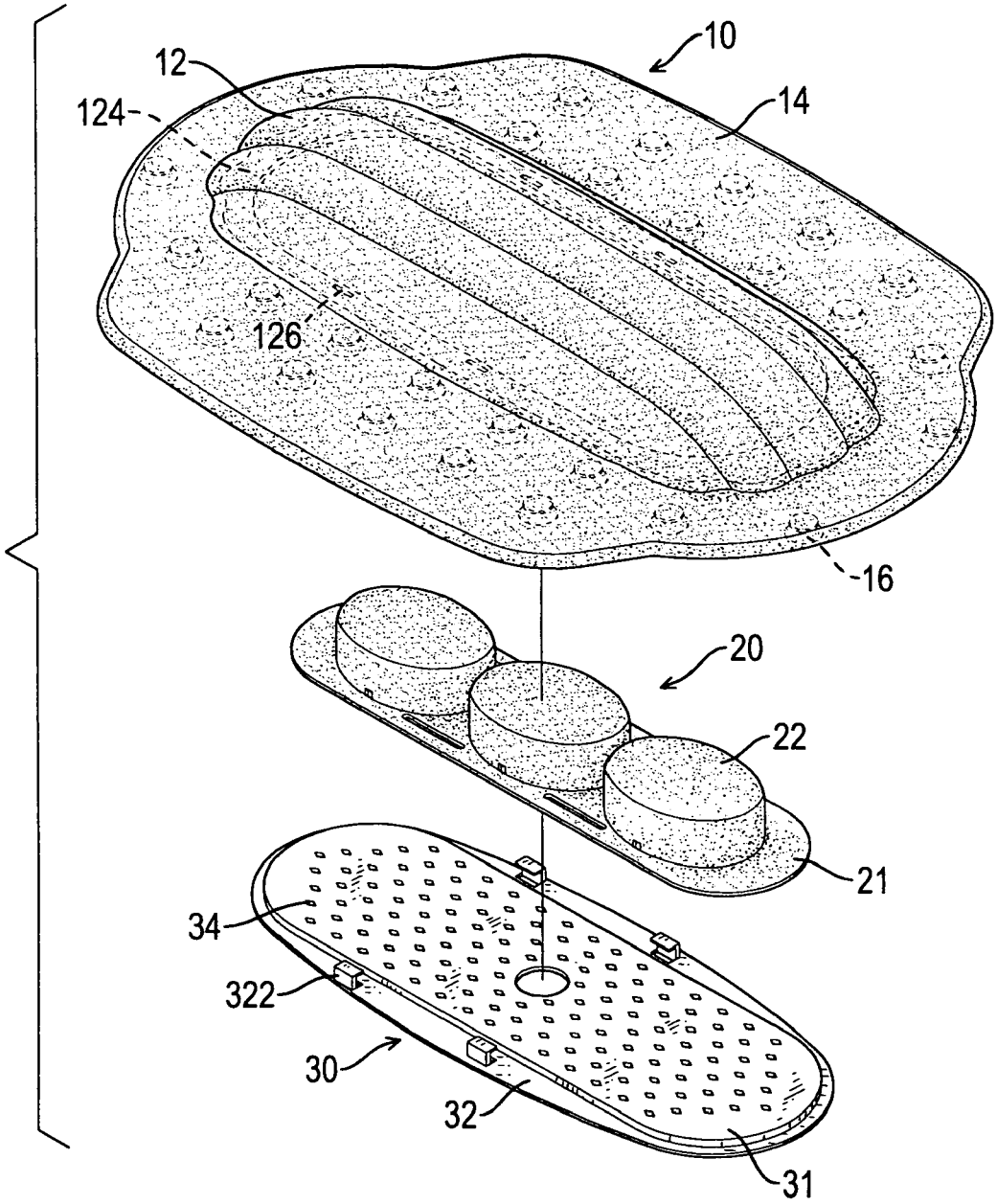
FIG. 1 is an exploded perspective view of a bathtub pillow in accordance with the present invention.
Figure 2:
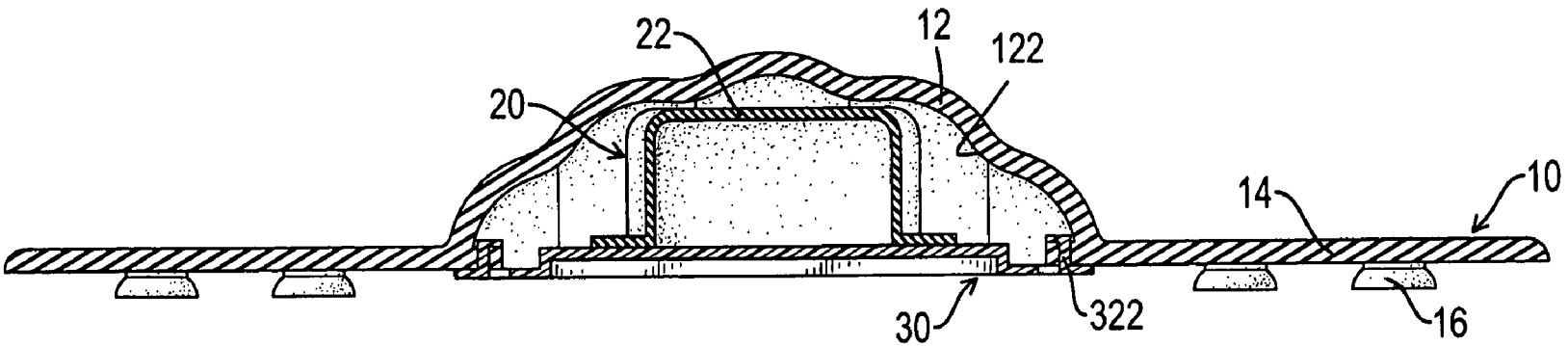
FIG. 2 is a cross-sectional side view of the bathtub pillow in FIG. 1.

With reference to FIGS. 1 and 2, a preferred embodiment of the bathtub pillow of the present invention comprises a resilient cover (10) with multiple sucking disks (16), a resilient spacer (20) and a bottom grating (30).

Figure 3:
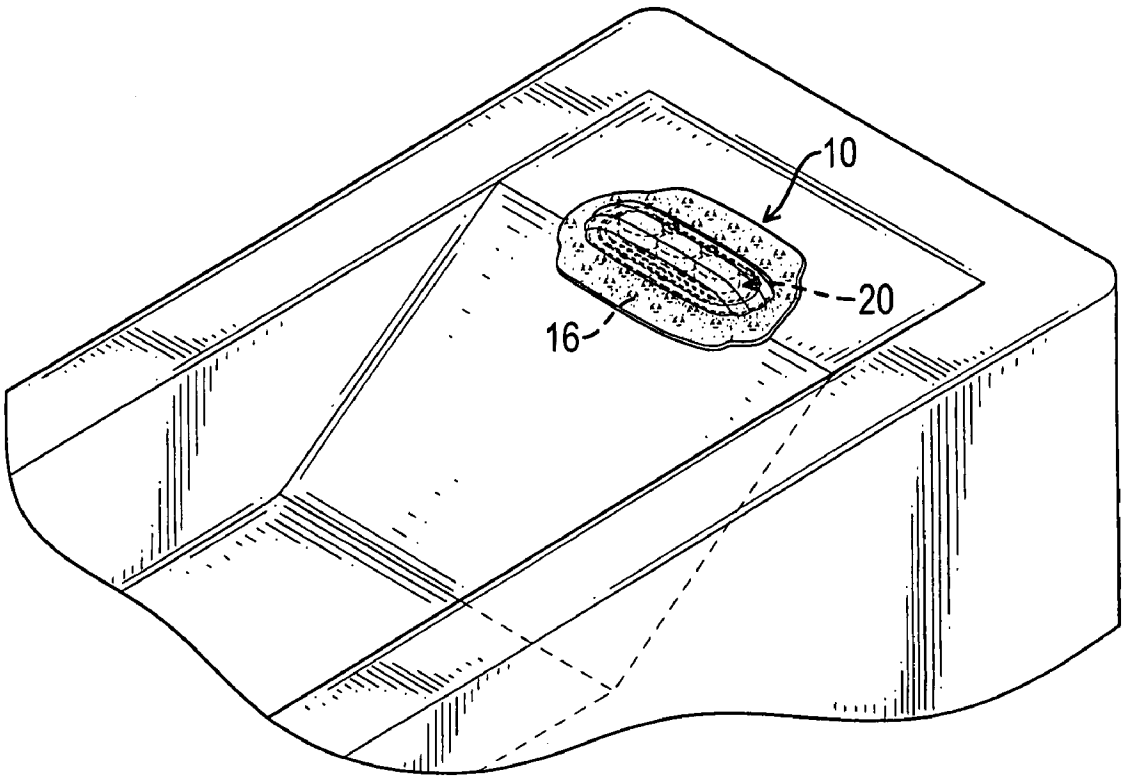
FIG. 3 is an operational perspective view of the bathtub pillow in FIG. 1, wherein the bathtub pillow is mounted on a bathtub.

The resilient cover (10) is made of elastic rubber and kept in shape having a bulged portion (12) and a flat area (14) formed around the bulged portion (12). The bulged portion has a cavity (122) inside. The resilient cover (10) further has an inner flange (124) extending from the flat area (14) inward to the cavity (122) and multiple holes (126) defined in the inner flange (124). The multiple sucking disks (16) are integrally formed under the flat area (14) of the resilient cover (10) to adapt to suck on a bathtub as shown in FIG. 3.

The resilient spacer (20) is received inside the cavity (122) and is made of elastic rubber that has less rigidity than the resilient cover (10). The resilient spacer (20) is shaped into a plate (21) having three hollow bulges (22) formed on the plate (21) to prop up the bulged portion (12) of the resilient cover (10) and to provide a restitution force to the resilient cover (10). Therefore, when a user rests his head on the bathtub pillow, the bulged portion (12) will not suddenly sink but is gently supported by the spacer (20) to avoid the user's head bumping the bathtub directly. Moreover, when a pressing force on the bulged portion (12) on the resilient cover (10) is released, the bulged portion (12) recovers to the original shape easily by the restitution force.

The bottom grating (30) is made of rigid plastic to avoid the resilient cover (10) deforming in width and is detachably attached under the resilient cover (10) below the cavity (122) to enclose the spacer (20) inside the cavity (122). The bottom grating (30) has an oval board (31), an outer rim (32), multiple hooks (322) and multiple rhombus holes (34). The oval board (31) is configured to cover the cavity (122) completely. The outer rim (32) is formed around the board (31) and the multiple hooks (322) are formed on the outer rim (32) to extend to the resilient cover (10). The hooks (322) correspondingly engage with the holes (126) on the inner flange (124) so that the bottom grating (30) is detachable to make cleaning of the bathtub pillow easy. The multiple rhombus holes (34) are defined in the board (31) to allow water inside the cavity to drain out to allow the bathtub pillow to dry out after use.

Figure 4:
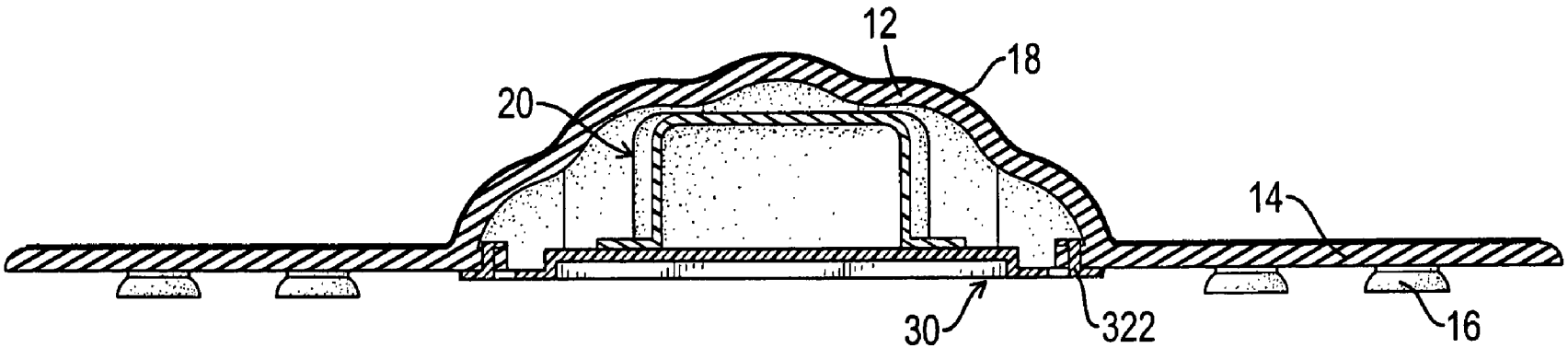
FIG. 4 is a perspective view of another embodiment of the bathtub pillow in accordance with the present invention.
Figure 5:
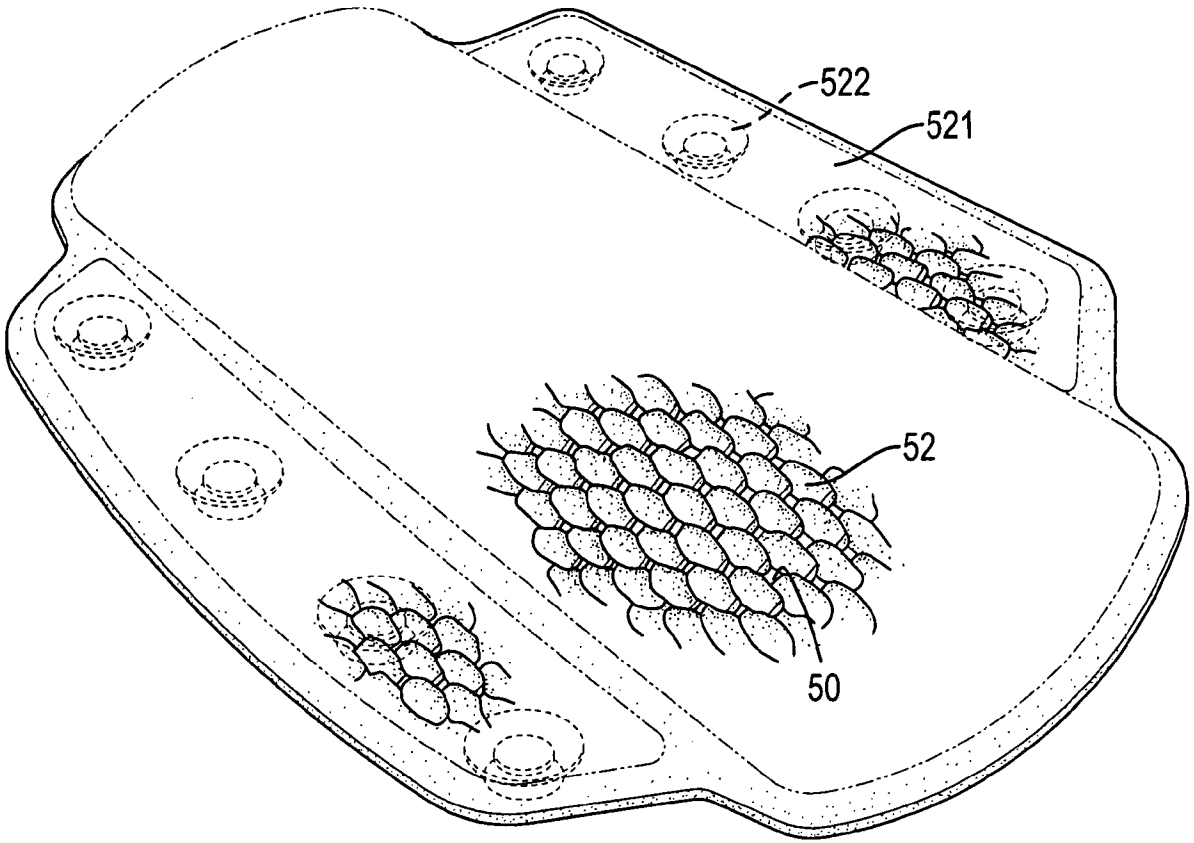
FIG.5 PRIOR ART
FIG. 5 is perspective view of a conventional bathtub pillow in accordance with the prior art.
Figure 6:
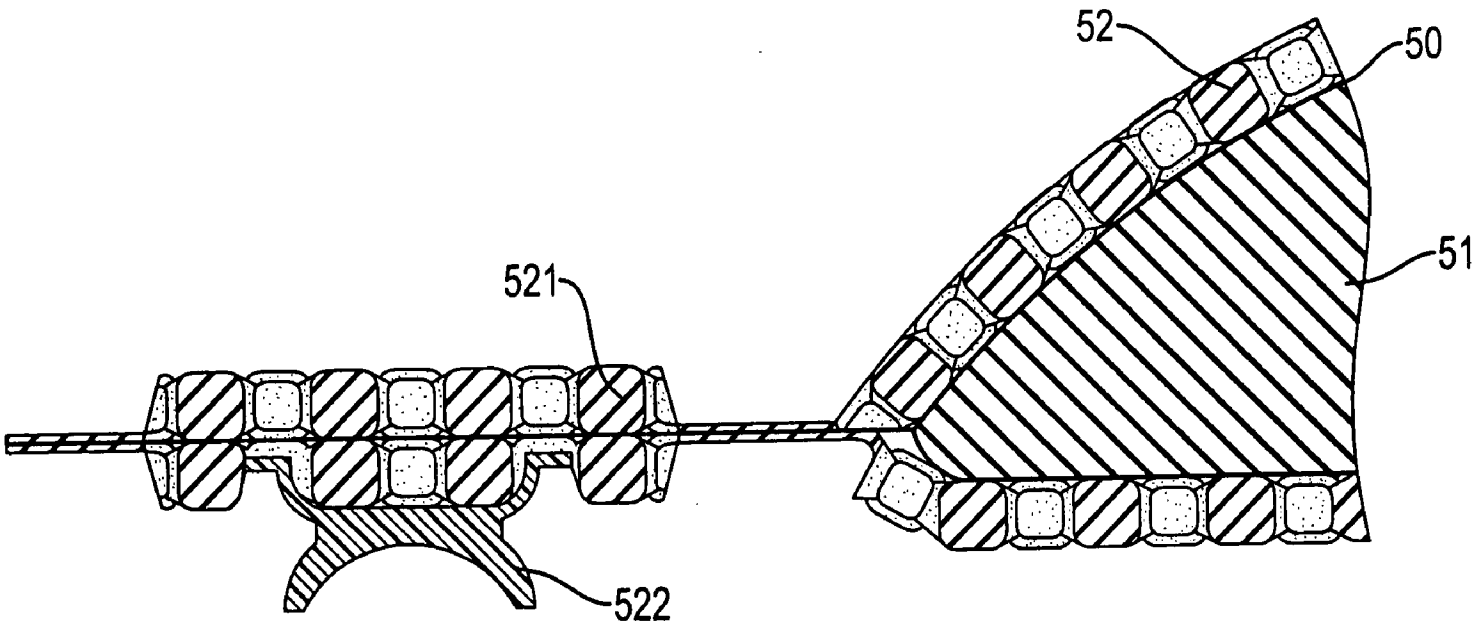
FIG.6 PRIOR ART
FIG. 6 is a partially cross-sectional side view of the conventional bathtub pillow in FIG. 5.

With reference to FIG. 4, the resilient cover (10) further has a patterned cloth with vivid colors and pictures printed on surfaces to make the bathtub pillow especially attractive.

According to the foregoing description, the bathtub pillow of the present invention has the following advantages:

1. The bathtub pillow is achieved by simply engaging the hooks (322) and the holes (126) together, therefore, combination of the bathtub pillow is convenient and manufacturing cost of the bathtub pillow is low.
2. Moreover, the bathtub pillow is detachable to make cleaning of the bathtub pillow easy.
3. Without the seams as shown in the conventional bathtub pillow, the bathtub pillow of the present invention does not become contaminated with dirt easily.
4. By not using the sack (50) made of plastic material in the conventional bathtub pillow, the bathtub pillow in the present invention has a longer life-span in comparison with the conventional one.

Although the invention has been explained in relation to its preferred embodiment, it is to be understood that many other possible modifications and variations can be made without departing from the spirit and scope of the invention as hereinafter claimed.

What is claimed is:

1. A bathtub pillow comprising:

a resilient cover (10) with a bulged portion (12) having a cavity (122) and a flat area (14) formed around the bulged portion (14);

a resilient spacer (20) received inside the cavity (122) of the bulged portion (12) of the resilient cover (10);

multiple sucking disks (16) formed under the flat area (14) of the resilient cover (10); and a bottom grating (30) detachably attached to the resilient cover (10) to enclose the resilient spacer (20) inside the bulged portion (12).

2. The bathtub pillow as claimed in claim 1, wherein the resilient cover (10) further has an inner flange (124) extending from the flat area (14) into the cavity (122) and multiple holes (126) defined in the inner flange (124); and the bottom grating (30) further has an outer rim (32) and multiple hooks (322) formed on the outer rim (32) to extend toward to the resilient cover (10) and to correspondingly engage with the multiple holes (126) on the resilient cover (10).

3. The bathtub pillow as claimed in claim 2, wherein the resilient spacer (20) has less rigidity than the resilient cover (10) and is shaped into a plate (21) having three hollow bulges (22) formed on the plate (21) to prop up the bulged portion (12) of the resilient cover (10).

4. The bathtub pillow as claimed in claim 3, wherein the resilient cover (10) further has a pattern clothed (18) attached on surfaces of the resilient cover.

5. The bathtub pillow as claimed in claim 2, wherein the resilient cover (10) further has a patterned cloth (18) attached on surfaces of the resilient cover (10).

6. The bathtub pillow as claimed in claim 1, wherein the resilient spacer (20) has less rigidity than the resilient cover (10) and is shaped into a plate (21) having three hollow bulges (22) formed on the plate (21) to prop up the bulged portion (12) of the resilient cover (10).

7. The bathtub pillow as claimed in claim 1, wherein the resilient cover (10) further has a patterned cloth (18) attached on surfaces of the resilient cover (10).

* * * * *